US006100461A

United States Patent [19]

Hewitt

[11] Patent Number: 6,100,461

[45] Date of Patent: Aug. 8, 2000

[54] WAVETABLE CACHE USING SIMPLIFIED LOOPING

[75] Inventor: Larry Hewitt, Austin, Tex.

[73] Assignee: Advanced Micro Devices, Inc., Sunnyvale, Calif.

[21] Appl. No.: 09/095,268

[22] Filed: Jun. 10, 1998

[51] Int. Cl.[7] ..... G10H 7/00

[52] U.S. Cl. ..... 84/603; 84/602; 84/604; 84/622; 84/659

[58] Field of Search ..... 84/601–606, 622–625, 84/645, 659–660

[56] References Cited

U.S. PATENT DOCUMENTS

| | | | |
|---|---|---|---|
| 5,677,503 | 10/1997 | Kurata | 84/604 |
| 5,689,080 | 11/1997 | Gulick | 84/604 |
| 5,717,154 | 2/1998 | Gulick | 84/604 |
| 5,753,841 | 5/1998 | Hewitt | 84/604 |
| 5,809,342 | 9/1998 | Gulick | 395/884 |
| 5,847,304 | 12/1998 | Hewitt | 84/622 |
| 5,890,115 | 3/1999 | Cole | 704/258 |

*Primary Examiner*—Stanley J. Witkowski
*Assistant Examiner*—Marlon T. Fletcher
*Attorney, Agent, or Firm*—Skjerven, Morrill, MacPherson, Franklin & Friel, LLP

[57] ABSTRACT

A wavetable audio synthesis system includes a simplified burst data transmission interface and a modified wavetable data structure in a system memory to transfer wavetable data from the system memory to a wavetable audio synthesis device with reduced hardware complexity. The system memory is configured to store voice data in patches including a plurality of voice data samples beginning at an initial address and extending through a plurality of ramp voice data samples to a starting loop address. The voice data in the patches then includes a plurality of looping voice data samples from the starting loop address to an ending loop address. The voice data patches are extended by repeating the voice data samples beginning with the sample at the starting loop address and extending toward the samples at the ending loop address. The number of repeated samples extend for a number of samples equal to the size of a burst transfer. The repeated samples are appended to the voice data patches following the ending loop address.

20 Claims, 5 Drawing Sheets

System Memory DWORDs

400

| | |
|---|---|
| Start of patch | xxxxAAAA |
| +4 | BBBBCCCC |
| +8 | DDDDEEEE |

• • •

| | |
|---|---|
| SA-2 | 11112222 |
| SA+2 | 33334444 |
| SA+6 | 55556666 |

• • •

| | |
|---|---|
| EA-12 | FFFFEEEE |
| EA-8 | DDDDCCCC |
| EA-4 | BBBBAAAA |
| EA | 99992222 |
| EA+4 | 33334444 |
| EA+8 | 55556666 |

• • •

WAVETABLE CACHE USING SIMPLIFIED LOOPING

BACKGROUND OF THE INVENTION

Many present-day computer systems, such as personal computer systems, incorporate multimedia devices such as audio peripherals, motion video peripherals, graphics systems and the like. The multimedia devices are commonly implemented as add-in cards of desktop and portable computers or integrated circuit designs for installation on a system circuit board.

Audio peripherals are commonly available as digital audio systems using a standard Musical Instrument Device Interface (MIDI) serial communication protocol for performance of audio voice signals. One type of audio peripheral is a wavetable-type music synthesizer that uses classic filter, amplifier, and modulation circuits to produce many various musical sounds. A wavetable device synthesizes musical signals from multiple oscillation signals that are stored in a memory, sampled, and synthesized in a plurality of waves in rapid succession. Two fundamental components of a wavetable audio synthesis device are a memory for storing wavetable data and musical signal processing circuits, including a digital signal processor.

An important aspect of the performance of a wavetable audio synthesis device is the effectiveness of the data transfer path between the memory and the musical signal processing circuits. Some systems increase the bandwidth between the memory and the musical signal processing circuits by supplying the musical processing circuits with a local memory interface. However, supplying a local memory in combination with the audio circuits substantially increases the cost as size of the audio peripheral. Furthermore a system that includes a special local memory subsystem in combination with the audio peripheral complicates device installation and generally increases servicing and warranty costs to a manufacturer. In addition, the wavetable data must be downloaded to the local memory subsystem, complicating software handling of the audio peripheral and causing delays when data is replaced.

One technique for increasing the bandwidth of data transfers between the memory and the musical signal processing circuits is to transfer data using burst transmissions using a single address timing phase and multiple data phases.

Many advantages are gained by supplying the wavetable data in a standard system memory. First, the general procedure for handling data in a computer system is through the main system memory. Second, operating system software generally handles data in a most efficient manner through usage of the main system memory. Data entries from all peripheral storage devices, including magnetic disks, CD-ROM, and the like, are transferred through the main system memory.

In a wavetable cache design that utilizes a system memory for supplying wavetable data, several samples of data are typically transferred from the system memory to the audio peripheral for each monophonic synthesizer or voice. The group of samples is sufficient to process several frames of data for the voice. A frame is the sample period of a digital-to-analog converter (DAC) and is generally standardized to a duration of $1/44100$ second. A frame-batch is a group of frames that are generally processed for a voice after the data samples for the voice are transferred from the system memory to the audio peripheral.

The effectiveness of the data transfer path between the memory and the musical signal processing circuits and therefore the performance of a wavetable audio synthesis device are affected by any patterns of wavetable data access that occur inherently or naturally, or may be forced to occur. For example, an audio digital signal processor (DSP) typically forms some voices such as voices associated with acoustic guitars, pianos, and many other instruments, using a looping access. A note played for these voices includes a signal having an initial rapidly-changing timbre for a specified duration, followed by a period of relative stability as the volume of sound produced by the instrument decays. During the period of stability of the timbre, the audio DSP repeatedly processes a group of data samples while a volume envelope is applied that reduces the amplitude of the voice to a level of zero.

One problem with a conventional wavetable audio synthesis device that receives wavetable data from a system memory by burst transmission is the handling of data bursts that extend beyond the end address of a loop data sample. Typically, burst transmission is attained through usage of hardware circuits that cancel data samples from the system memory that extend beyond a predetermined end address and circuits that insert the canceled samples prior to accessing samples from a starting address. These hardware circuits include buffers and control logic that disadvantageously consume a large area of integrated circuit in a wavetable audio synthesis device.

What is needed is an improved apparatus and technique for communicating data from the main system memory over a system bus to an audio device peripheral using burst transmission.

SUMMARY OF THE INVENTION

A wavetable audio synthesis system includes a simplified burst data transmission interface and a modified wavetable data structure in a system memory to transfer wavetable data from the system memory to a wavetable audio synthesis device with reduced hardware complexity. The system memory is configured to store voice data in patches including a plurality of voice data samples beginning at an initial address and extending through a plurality of ramp voice data samples to a starting loop address. The voice data in the patches then includes a plurality of looping voice data samples from the starting loop address to an ending loop address. The voice data patches are extended by repeating the voice data samples beginning with the sample at the starting loop address and extending toward the samples at the ending loop address. The number of repeated samples extend for a number of samples equal to the size of a burst transfer. The repeated samples are appended to the voice data patches following the ending loop address.

In operation, the wavetable audio synthesis device receives data from the system memory as directed by a current address, a starting loop address, and an ending loop address that set pointers to data locations in the system memory. The wavetable audio synthesis device allows bursts that extend beyond the ending loop address to continue through the repeated samples appended beyond the ending loop address. Thus, when a burst of transmitted data crosses the ending address, the wavetable audio synthesis device does not stop the burst and re-establish the burst at the starting loop address. Instead, the wavetable audio synthesis device allows the burst to complete. The current address for the next burst is set to the starting loop address increased by the number of samples, the previous burst extended beyond the ending loop address. In this manner, the data transferred from the system memory to the wavetable audio synthesis device is the same as the data that would have been transferred had the burst been stopped at the ending loop address and re-established at the starting loop address but the result is advantageously achieved without dropping the data extending beyond the ending address.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

The use of the same reference symbols in different drawings indicates similar or identical items.

DESCRIPTION OF THE PREFERRED EMBODIMENT(S)

Figure 1:
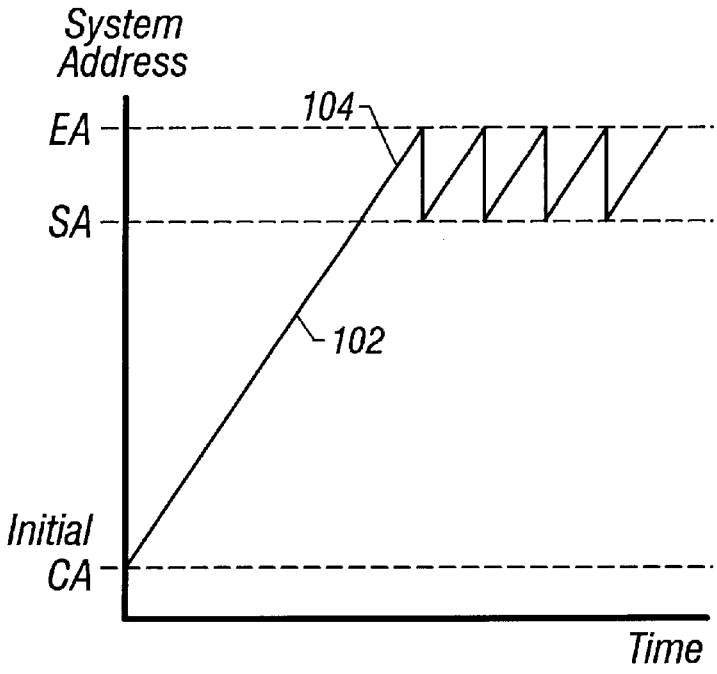
FIG. 1 is a graph illustrating a technique for accessing wavetable voice data using an initial ramp and looping following the ramp.

Referring to FIG. 1, a graph illustrates a technique for accessing wavetable voice data using an initial ramp 102 and looping 104 following the ramp. A set internal queue size of a wavetable synthesizer device such as the audio wavetable synthesizer integrated circuit 610 shown in FIG. 6 hereinafter limits the amount of data that is transferred to the device using burst transmission. In one embodiment, the audio wavetable synthesizer integrated circuit 610 receives burst data of no more than 64 samples at one time. Typically, a voice is performed or played by setting a current address (CA), a starting loop address (SA), and an ending loop address (EA), each of which is a pointer to address locations to a voice data patch in a system memory. The voice data patch includes data acquired from recorded samples from an instrument corresponding to the voice that are stored digitally in the system memory. The current address (CA) is dynamically updated as the voice is played. The starting loop address (SA) and the ending loop address (EA) are static values that are defined for the playing of a particular voice. Initially, in preparation for playing a note, the current address (CA) is set to an initial address in a voice data patch that extends from a base address at the beginning of the ramp 102 to a final address that may correspond to the ending loop address (EA). The starting loop address (SA) and the ending loop address (EA) are loop points in the voice data patch.

The current address (CA) is sent to the system memory to define the beginning data address of a block of data that is transmitted from the system memory to the wavetable synthesizer device for playing by a device such as the audio digital signal processor (DSP) 756 shown in FIG. 7 hereinafter.

The audio DSP is controlled to process the data in the initial ramp 102 then loop repeatedly 104 through a portion of the voice data patch within the system memory. The current address (CA), the starting loop address (SA), and the ending loop address (EA) control accessing of the initial ramp and loop data. Typically, a note that is played by an instrument includes an initial period of timing having a rapidly changing timbre, followed by a period of relative stability as the volume of sound produced by the instrument decays.

The audio DSP and the voice data patches are structured to reduce the amount of memory consumed to store the patch data. Many instruments including acoustic guitars, pianos, and many others have a voice that is recreated from sampled sounds using a ramp and looping technique. In an initial step in preparation for playing a note, the current address (CA) is placed at the beginning of a voice data patch. Typically, the current address (CA) is set to the first address in the patch although in some cases the current address (CA) may be set to other address locations. The starting loop address (SA) and ending loop address (EA) are generally set prior to preparation for playing the note. Data is transferred from the system memory and the transferred data is played by the audio DSP from the current address (CA) to the ending loop address (EA). By the time the audio DSP reaches the ending loop address (EA), the timbre of the sound produced by the instrument becomes relatively stable. The data is transferred from the system memory and played by the audio DSP by looping continuously between the starting loop address (SA) and the ending loop address (EA) in the system memory while the amplitude of the voice is reduced down to zero by application of a voice envelope.

To transfer data from the system memory to the audio DSP at a suitable rate to play a voice, the data is transferred using burst transmission. In one system embodiment, when a burst transfer extends beyond the ending loop address (EA), several complications occur. First, the number of samples transferred is disadvantageously reduced so that the burst address does not extend beyond the ending loop address (EA). Second, a next sequential burst transfers data beginning at the start address to carry the data that was reduced from the previous burst.

Third, the data granularity between the burst size and the starting loop address (SA) and ending loop address (EA) boundaries may be mismatched so that holes in the data may occur. The data holes may result in unpleasant sounds during playing of the voice. In one example, the data voice samples are 8 or 16 bits in length and the data bursts are transferred using a Peripheral Component Interconnect (PCI) bus that transfers data bursts in 32-bit DWORD units. The basic bus transfer mechanism on the PCI bus is a burst. A burst is composed of an address phase and one or more data phases. PCI supports bursts in both memory and I/O Address Spaces.

With the difference in data unit granularity, a buffer or queue for storing data transferred in the two bursts that overlap the ending loop address (EA) will contain a hole if the ending loop address (EA) does not point to the last sample of a DWORD or if the starting loop address (SA) does not point to the first sample of a DWORD.

A hardware design to avoid the complications has several disadvantages. A hardware design typically includes buffers and control logic that adds complexity to the circuit and adds cost by increasing the amount of integrated circuit surface area for implementing an interface in a audio wavetable synthesizer integrated circuit.

Figure 2:
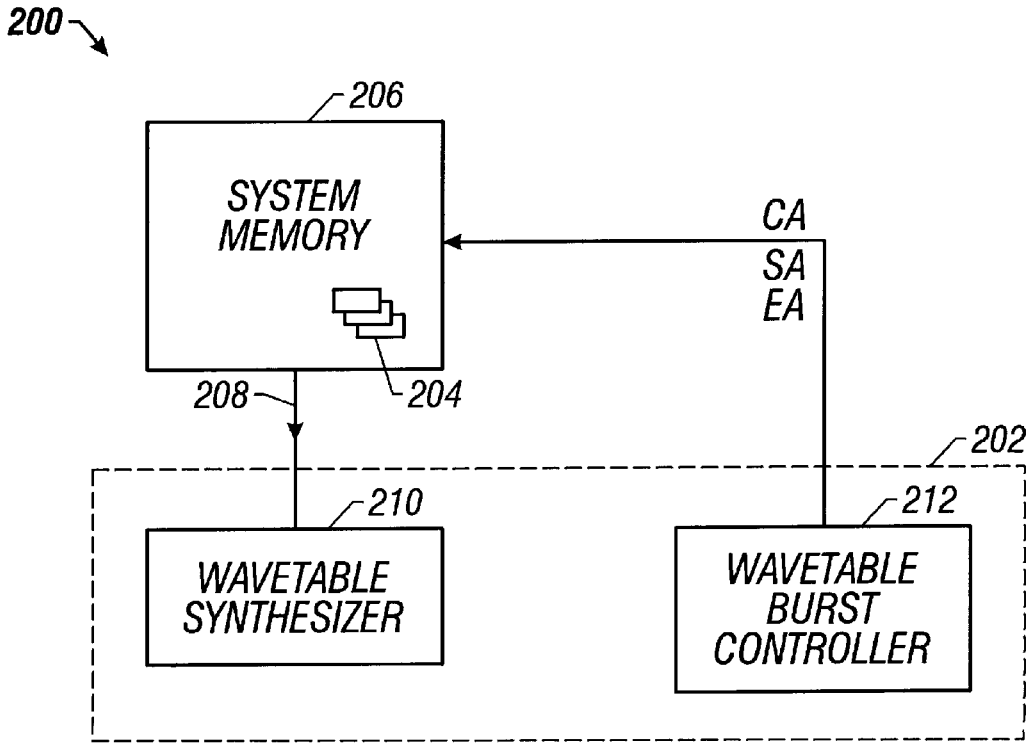
FIG. 2 is a simplified schematic block diagram showing a structure implementing simplification of looping in a wavetable cache.

Referring to FIG. 2, a simplified schematic block diagram shows a structure implementing simplification of looping in a wavetable audio synthesis system 200. The wavetable audio synthesis system 200 includes a simplified burst data transmission interface 202 and a modified wavetable data structure 204 in a system memory 206 to transfer wavetable data 208 from the system memory 206 to a wavetable audio synthesis device 210 with reduced hardware complexity. A wavetable data burst controller 212 controls communication of burst transfers from the system memory 206 to the wavetable audio synthesis device 210 by setting the dynamic value of the current address (CA) and the static values of the starting loop address (SA) and the ending loop address (EA). The wavetable data burst controller 212 sets the current address (CA) then requests a burst data transfer from the system memory 206 specifying the current address (CA) as the base address of the burst transfer.

Figures 3, 4:
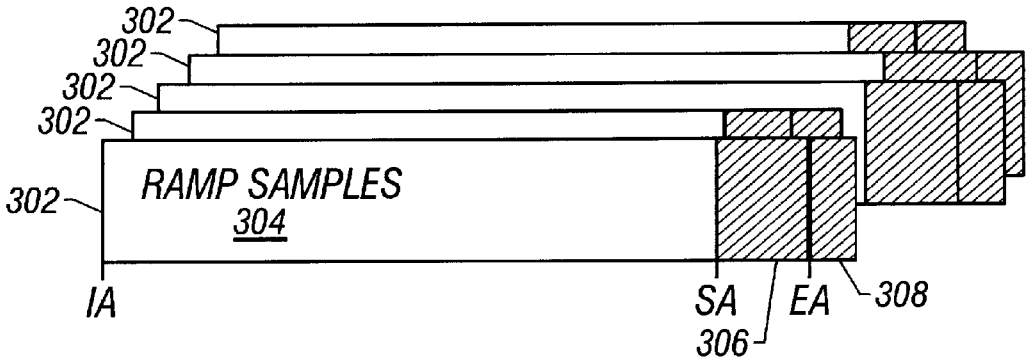
FIG. 3 is a graphic illustrations that shows a configuration of the modified wavetable data structure in the system memory.
FIG. 4 is a table that illustrates an example of a data arrangement showing a patch within the modified wavetable data structure of the system memory.

Referring to FIG. 3 in conjunction with FIG. 2, a graphic illustrates the configuration of the modified wavetable data structure 204 in the system memory 206. The modified wavetable data structure 204 is configured to store voice data in a plurality of patches 302. The patches 302 include a plurality of voice data samples beginning at an initial address IA and extending through a plurality of ramp voice data samples 304 to a starting loop address SA. The voice data in the patches 302 then include a plurality of looping voice data samples 306 from the starting loop address SA to an ending loop address EA. The voice data patches are extended by repeating the looping voice data samples 306 beginning with the sample at the starting loop address SA and extending toward the ending loop address EA. The repeated samples 308 extend for a number of samples equal to the size of a burst transfer BT. The repeated samples 308 are appended to the voice data patches 304 following the ending loop address EA.

Referring to FIG. 4, a table illustrates an example of a data arrangement showing a patch 400 within the modified wavetable data structure 204 of the system memory 206. In the illustrative example, the patch 400 includes a plurality of 16-bit words. Also in the example, the beginning of the patch 400, which corresponds to the initial location of the current address (CA), is located in the second half of a DWORD and shown having the value "AAAA". The illustrative starting loop address (SA) is also located in the second half of a DWORD and has a value of "2222" in the example. The ending loop address (EA) is located in the first half of a DWORD and has a value "9999". A number of samples equal to the size of a burst, in this example 64 samples, beginning at the starting loop address (SA) are repeated and appended to the patch 400 so that a burst that extends beyond the ending loop address (EA) by any amount is completed.

Figure 5:
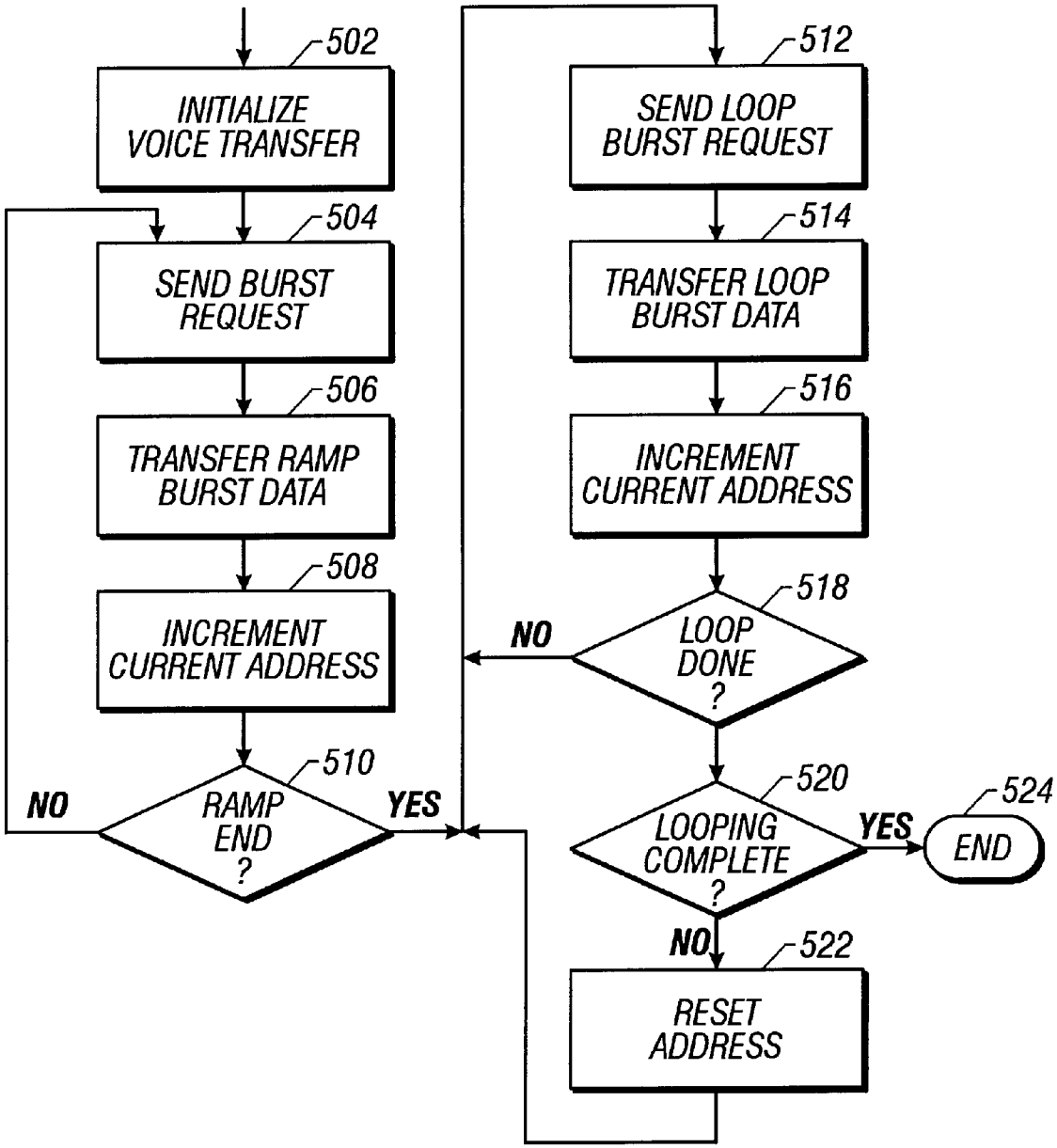
FIG. 5 is a flow chart that illustrates a suitable technique for simplified looping in a wavetable cache.

Referring to FIG. 5 in combination with operational structures shown in FIG. 3, a flow chart illustrates a suitable technique for simplified looping 500 in a wavetable cache. In an initialize voice transfer operation 502, the wavetable data burst controller 212 determines the current address (CA), the starting loop address (SA), and the ending loop address (EA) for a particular voice. In a send burst transfer request operation 504, the wavetable data burst controller 212 sends a transmission request to the system memory 206 that specifies the current address (CA). In a transfer ramp burst data operation 506, the system memory 206 transfers a block of burst voice data from the ramp portion of a patch 400 to the wavetable audio synthesis device 210 via the simplified burst data transmission interface 202.

The wavetable data burst controller 212 then increments the current address (CA) by the burst size 508. If the current address (CA) is below the starting loop address (SA), as determined by a check for ramp end operation 510, then the send burst transfer request operation 504 is repeated. Otherwise, the looping phase of the voice begins with a send looping burst transfer request operation 512 in which the wavetable data burst controller 212 sends a transmission request to the system memory 206 that specifies the current address (CA) between the starting loop address (SA) and the ending loop address (EA). In a transfer loop burst data operation 514, the system memory 206 transfers a block of burst voice data from the ramp portion of a patch 400 to the wavetable audio synthesis device 210 via the simplified burst data transmission interface 202.

The wavetable data burst controller 212 again increments the current address (CA) by the burst size 516. If the current address (CA) is below the ending loop address (EA), as determined by a check for loop end operation 518, then the send looping burst transfer request operation 512 is repeated. Otherwise, a check loop duration operation 520 determines whether the looping operation is complete. The loop duration is determined in one embodiment by incrementing a loop counter and terminating looping after a selected number of loops are performed. In another embodiment, the loop duration is tested by setting a starting time at the beginning of the patch 400 or when looping begins at the starting loop address (SA) and checking the time elapsed since the starting time. If the loop is complete, the simplified looping operation 500 completes with an end operation 524. Otherwise in a reset address operation 522, the wavetable data burst controller 212 subtracts the ending loop address (EA) from the current address (CA) that was incremented beyond the ending loop address (EA) in increment operation 516. By subtracting the ending loop address (EA) from the current address (CA), the wavetable data burst controller 212 adjusts for overflow beyond the ending loop address (EA). The overflow amount is added to the starting loop address (SA) to reset the current address and the send looping burst transfer request operation 512 is repeated.

The reset address operation 522 allows bursts that extend beyond the ending loop address to continue through the repeated samples that are appended beyond the ending loop address (EA). When a burst of transmitted data crosses the ending address, the wavetable audio synthesis device 210 does not interrupt the burst and re-establish the burst at the starting loop address but rather allows the burst to complete and readjusts the current address beyond the starting loop address (SA).

Figure 6:
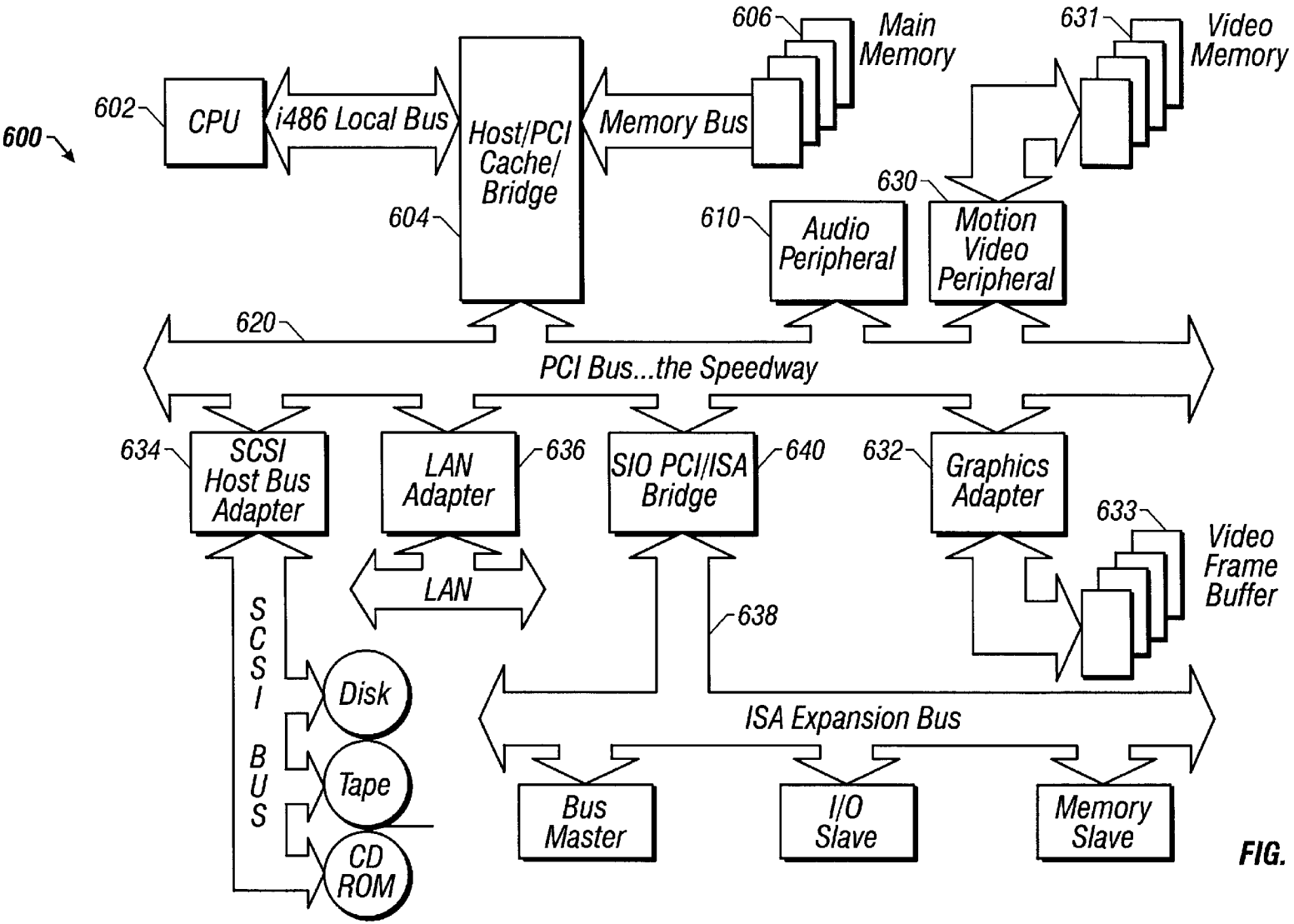
FIG. 6 is a schematic block diagram illustrating a computer system incorporating an audio wavetable synthesizer integrated circuit in accordance with one embodiment of the present invention.

FIG. 6 illustrates an audio performance computer system 600 including an audio wavetable synthesizer integrated circuit 610. The computer system 600 employs an architecture based on a bus, such as an Intel™ PCI bus interface 620, and includes a central processing unit (CPU) 602 connected to the PCI bus interface 620 through a Host/PCI/Cache interface 604. The CPU 602 is connected to a main system memory 606 through the Host/PCI/Cache interface 604. A plurality of various special-purpose circuits may be connected to the PCI bus interface 620 such as, for example, the audio wavetable synthesizer integrated circuit 610, a motion video circuit 630 connected to a video memory 631, a graphics adapter 632 connected to a video frame buffer 633, a small systems computer interface (SCSI) adapter 634, a local area network (LAN) adapter 636, and perhaps a expansion bus such as an ISA expansion bus 638 which is connected to the PCI bus interface 620 through an SIO PCI/ISA bridge 640.

The audio wavetable synthesizer integrated circuit 610 accesses musical voice data in several different voices and processes the multiple voice data into a single set of audio signals, such as stereo audio signals, although other audio formats such as three-output, five-output, theater-in-the-home formats and other audio formats are also possible. A voice data signal is a single defined sound such as a note of one instrument, a digital audio file, or a digital speech file.

The audio wavetable synthesizer integrated circuit 610 advantageously supplies high-quality, low-cost audio functions in a personal computer environment. The audio wavetable synthesizer integrated circuit 610 supports logic functions and digital signal processing for performing audio functions typically found in personal computer systems. The audio wavetable synthesizer integrated circuit 610 incorporates a polyphonic music synthesizer and a stereo codec. The audio wavetable synthesizer integrated circuit 610 generates audio signals based on data that is received from the main system memory 606, rather than through a local memory interface. Accordingly, performance of the audio wavetable synthesizer integrated circuit 610 is highly dependent on the bus communication structures of the computer system 600. In one embodiment, the audio wavetable synthesizer integrated circuit 610 addresses up to 64 Mbytes of system memory 606 and generates an audio signal including up to 32 simultaneous voices.

Various embodiments of the computer system 600 use operating systems such as MS-DOS™, Windows™, Windows 95™, Windows NT™ and the like.

Figure 7:
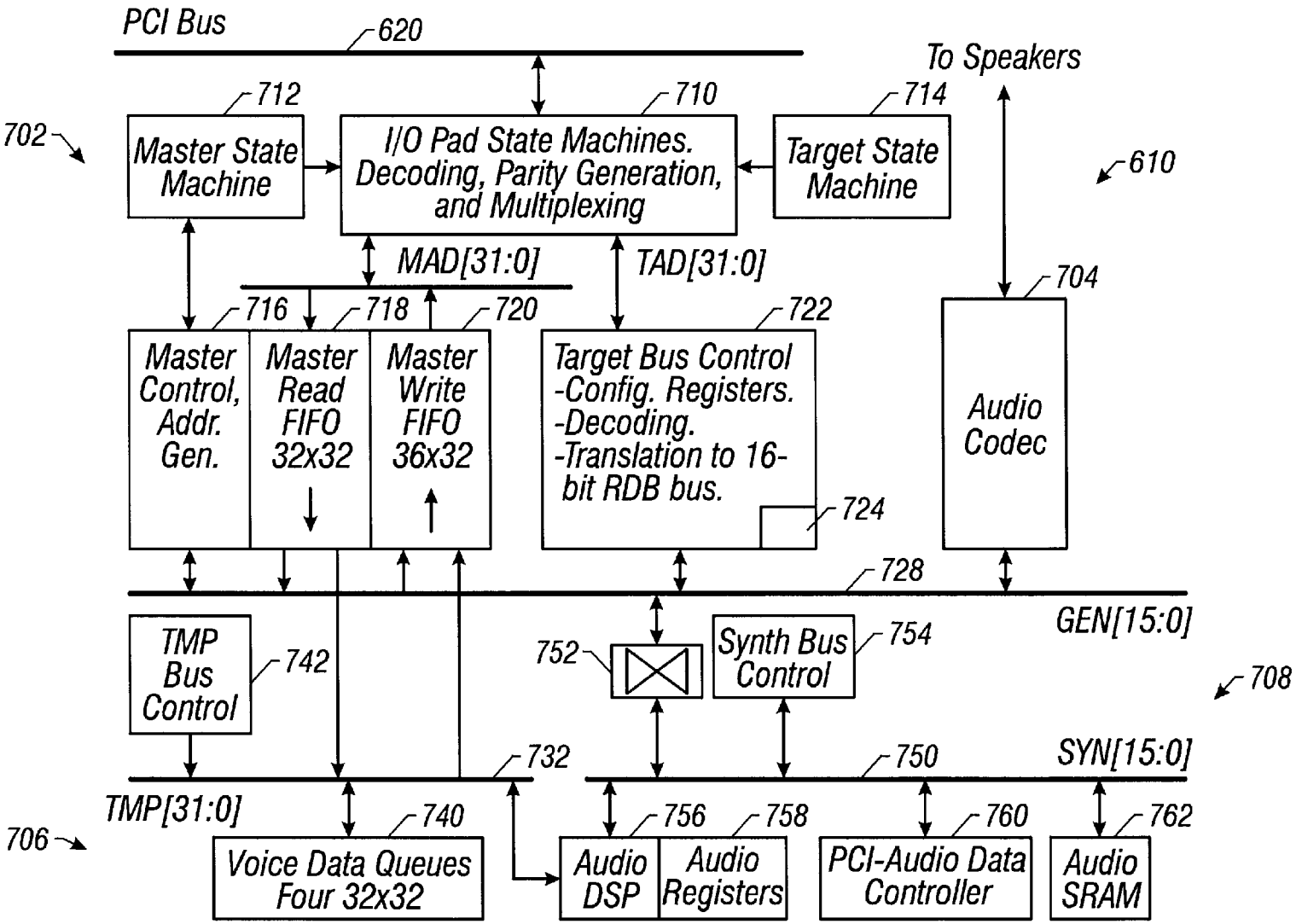
FIG. 7 is a schematic block diagram illustrating an embodiment of the audio wavetable synthesizer integrated circuit for performing logic and digital signal processing supporting audio functions and including a vertical wavetable cache in accordance with an embodiment of the present invention.

Referring to FIG. 7, a schematic block diagram illustrates an embodiment of the audio wavetable synthesizer integrated circuit 610 performs logic and digital signal processing supporting audio functions implemented in a personal computer. The audio wavetable synthesizer 610 is connected to a PCI bus interface 620 and includes a PCI bus interface unit 702, an audio codec 704, an audio cache 706, and an audio synthesizer 708.

The PCI bus interface unit 702 is connected between the PCI bus 620 and two buses internal to the audio wavetable synthesizer 610, specifically a general (GEN) bus 728 and a temporary (TMP) bus 732. The TMP bus 732 is internal to the audio cache 706. The audio cache 706 includes the TMP bus 732, a TMP bus control circuit 742 and a voice data queue 740. The TMP bus control circuit 742 and the voice data queue 740 are connected to the TMP bus 732.

The audio synthesizer 708 is connected to the GEN bus 728 and communicates via the PCI bus 620 through the PCI bus interface unit 702. The audio synthesizer 708 includes a 16-bit synthesizer bus 750 which is connected to the GEN bus 728 by a synthesizer bus interface 752. The audio synthesizer 708 includes a synthesizer bus controller 754, an audio digital signal processor (DSP) 756, a plurality of digital signal processor (DSP) registers 758, a PCI-Audio data controller 760, and an audio static random access memory (SRAM) 762. The audio DSP 756 is connected to the synthesizer bus 750 and connected to the TMP bus 732 of the audio cache 706. The synthesizer bus controller 754, the PCI-Audio data controller 760, and the audio SRAM 762 are connected to the synthesizer bus 750. The DSP registers 758 are connected to the audio DSP 756.

The audio DSP 756 processes the multiple voices of the digital musical signal by performing various known signal processing functions, most fundamentally by performing sample rate conversion and mixing. Sample rate conversion is performed so coordinate the input signal rate of a musical voice signal to an output audio rate since a single output rate is imposed and the input signals commonly may have multiple different sampling rates. For example, the output rate of the audio DSP 756 may be 44.1 kHz while the input rate of a signal such as a telephony-type codec is 8 kHz so that the audio DSP 756 interpolates to generate an output signal at 44.1 kHz.

Furthermore, voice memory is conserved by storing a single voice musical system to represent multiple octaves of a note. The sample rate is converted to provide multiple harmonic key registers to a single stored note. For example, a voice file is typically recorded at the output frequency of the audio DSP 756 (44.1 kHz). A voice signal corresponding to a single key, for example a middle-C, is recorded at 44.1 kHz and saved in the memory so that the sample rate conversion frequency ratio $F_c$ is equal to one. To conserve memory, other harmonics of the voice signal such as a D or E is generated by reading the sample corresponding to a middle-C and converting the sample rate. The output frequency is increased by a fill octave for an $F_c$ equal to two, and increased by two octaves for an $F_c$ equal to four.

The sample rate conversion frequency ratio $F_c$ represents the rate at which the audio wavetable synthesizer integrated circuit 610 processes a data file in the system memory 606. Thus, the sample rate conversion frequency ratio $F_c$ is important for determining an favorable size of each queue of the voice data queue 740. If the sample rate conversion frequency ratio $F_c$ is large, data is accessed from the queue at a high rate so a large queue is advantageous for reducing the servicing of the queue. However, if the queue is too large, the audio wavetable synthesizer integrated circuit 610 must include a large amount of memory, disadvantageously increasing the size of the circuit.

The audio wavetable synthesizer integrated circuit 610 processes all of the data for a single voice at one time so that the size of the queue for handling a single voice determines the performance of the audio performance computer system 600. If the queue for storing data for a single voice is small, the audio wavetable synthesizer integrated circuit 610 must frequently request data from the system memory 606, reducing performance by increasing traffic on the PCI bus 620 and delaying processing of audio signals. Using a small queue, performance is audio processing performance is further reduced when the sample rate conversion frequency ratio $F_c$ is large.

The voice data queue 740 is therefore designed in a vertical cache structure having large voice queues but reducing the number of voice queues that are active at one time. In particular, the vertical cache structure includes a substantially reduced set of active voice queues, typically three or four, rather than having an active voice queue for each performed voice. Each of the active voice queues in the vertical cache structure is substantially larger than the voice queues in a system having an active voice queue for each performed voice. In this manner, data communication between the system memory 606 and the audio DSP 756 is greatly reduced while the queue memory size in the audio wavetable synthesizer integrated circuit 610 is not increased.

In the vertical cache structure, the illustrative voice data queue 740 includes 5four queues instead of having a queue allocated to each voice. Data from the system memory 606 is accessed to fill a single queue at a time so that the audio DSP 756 operates on a plurality of frames in a "frame batch" for each voice at one time. In the illustrative embodiment, a frame batch includes 32 frames. The PCI-Audio data controller 760 requests 32 frames of data for a single voice from the system memory 606. The 32 frames of single-voice data are communicated from the system memory 606 to the voice data queue 740 in a burst mode. The audio DSP 756 processes the 32 frames of data for the single voice and the results are accumulated by the audio DSP 756 and stored in the audio SRAM 762. The PCI-Audio data controller 760 then requests 32 frames of data for a next single voice, progressing through all 32 voices but processing the frame batch data for each voice separately.

The PCI bus 620, like most buses, operates more efficiently when data is communicated in a block at one time rather than by transmitting data a single piece at a time. Thus, the vertical cache structure advantageously processes multiple samples of a single voice at one time.

The number of voice queues in the voice data queue 740, typically three or four voice queues, is selected so substantially increase the size of a single voice queue while maintaining the total size of the voice data queue 740 at a reasonable level. Multiple voice queues are implemented so that data is loaded from the system memory 606 to a first voice queue of the voice data queue 740 while data is a written from a second voice queue to the audio DSP 756 so that the first voice queue is filled as the data from the second voice queue is processed. More than two voice queues are implemented to assure that the signal processing circuits of the audio DSP 756 remain bus, reducing the possibility that a queue will become empty due to bus latencies or congestion on the PCI bus 620. The latencies involved in communicating data via the PCI bus 620 vary widely and unpredictably based on the specifications and load of the audio performance computer system 600. The processing of the audio DSP 756 proceeds at a generally steady pace while the filling of the queues from them system memory 606 via the PCI bus 620 is highly variable.

The operation of the voice data queue 740 is illustrated by an example in which voice 0 data is previously loaded into a voice queue 0 and is presently accessed by the signal processor circuits of the audio DSP 756. Voice 1 data is filled into voice queue 1 of the voice data queue 740, voice 2 data is filled into voice queue 2, and voice 3 data is filled into voice queue 3 as the voice 0 data is processed by the audio DSP 756. When processing of the voice 0 data is complete, the audio DSP 756 begins processing of the voice 1 data from the voice 1 queue while filling of voice queues 1, 2 and 3 is completed if such filling is not yet completed and voice queue 0 is filled with voice 4 data. In subsequent cycles, voice 5–31 data are filled into the voice data queue 740 and processed. In this manner, data from the system memory 606 is filled into the voice data queue 740 over the PCI bus 620 asynchronously from the processing of the queued data by the audio DSP 756.

Mixing is performed to mix the signals of the multiple voices to create a composite sound. The audio DSP 756 also performs other processing such as separation of a voice into two channels for stereo performance, balancing the signal between different channels, performing three-dimensional localization of multiple output signal channels and other operations.

The DSP registers 758 include an audio DSP system memory address register (ADSMA) and an audio DSP master control register (ADMC). The audio DSP system memory address register (ADSMA) has a format, as follows:

| 31:0 |
|---|
| SAP |

where SAP is a system address pointer. The system address pointer specifies the system address pointer for master data accesses.

The audio DSP master control register (ADMC) has a format, as follows:

| 15:9 | 8 | 7:6 | 5:0 |
|---|---|---|---|
| Reserved | RdWr_L | TMPqueue | DWCount |

where DWCount is a doubleword (DWORD) count, TMPqueue is a TMP-bus queue number, and RdWr_L is a read-write bit. DWCount specifies the number of double words (DWORDs) to be accessed from system memory 606 in a PCI burst. TMPqueue specifies which of four data queues on the TMP bus 732 is the source or destination of the data. The read-write bit RdWr_L, when reset, specifies that the system memory master access is to originate from the PCI master write data FIFO 720 and be written to system memory 606. The read-write bit RdWr_L, when set, specifies that the system memory access is to originate from system memory 606 and be sent to the PCI master read data FIFO 718.

The PCI bus interface unit 702 includes a bus interface circuit 710, a master state machine 712, and a target state machine 714. The PCI bus interface unit 702 also includes a PCI bus master control unit 716, a PCI master read data FIFO 718, a PCI master write data FIFO 720, a target data to bus converter 722, and configuration registers 724.

The bus interface circuit 710 is directly connected to the PCI interface 620, the master state machine 712 and the target state machine 714. The bus interface circuit 710 includes I/O pad state machines, latches, decoding circuits, parity generation circuits and multiplexers for handling data transfer to the audio wavetable synthesizer 610. The I/O pad state machines of the bus interface circuit 710 are simple controllers for PCI output signals. The master state machine 712 and the target state machine 714 generate control signals for controlling input and output signals of the PCI bus interface unit 702 according to the PCI protocol and track the current state of the PCI bus 620. The bus interface circuit 710, master state machine 712, and target state machine 714 are designed to comply to PCI bus timing rules and generally operate as slaves to the PCI bus 620 and to the PCI bus master control unit 716.

Target data accesses are controlled by the target state machine 714 and pass from the PCI bus 620 through the bus interface circuit 710 to a target address and data (TAD) bus 726. The TAD bus 726 has a width of 32 bits. The target data accesses are passed from the TAD bus 726 to a destination determined by the target address, either the configuration registers 724 on the TAD bus 726 or through the target data to bus converter 722 to the general (GEN) bus 728. The GEN bus 728 conveys target data accesses to the audio DSP 756. The GEN bus 728 has a width of sixteen bits. The target data to bus converter 722 converts 32-bit data from the TAD bus 726 into a 16-bit data form for placement on the GEN bus 728. The target data to bus converter 722 includes configuration registers and decoders for converting the data. Target data accesses are generated by the CPU 602 and controlled by the target state machine 714 to control operations of the audio DSP 756 and the PCI bus master control unit 716.

Master data are passed from the PCI bus 620 through the bus interface circuit 710 to a master address and data (MAD) bus 728. Master data includes wavetable data read from the wavetable data in system memory 206. The MAD bus 730 has a width of 32 bits. Under control of the PCI bus master control unit 716, data is passed from the MAD bus 730 to the GEN bus 728 or to the temporary (TMP) bus 732 through the PCI master read data FIFO 718. The TMP bus 732 carries sample voice data to the voice data queue 740. The TMP bus 732 has a width of 32 bits. Also under control of the PCI bus master control unit 716, data is passed from the GEN bus 728 or from the TMP bus 732 to the MAD bus 730 through the PCI master write data FIFO 720.

The PCI bus master control unit 716 is connected to the MAD bus 730, the GEN bus 728 and the TMP bus 732 for communicating master data. The PCI bus master control unit 716 manages interfacing to the master state machine 712 to initiate master bus cycles. The PCI bus master control unit 716 generates addresses for accessing data in the system memory 606. The PCI bus master control unit 716 includes an array of programmable registers (not shown) which are programmed to generate automatic data access signals to the system memory 606. The PCI bus master control unit 716 then directs the transfer of the accessed data to either the GEN bus 728 or the TMP bus 732. The programmable registers in the PCI bus master control unit 716 are programmed to generating both read and write accesses to the system memory 606. The programmable registers in the PCI bus master control unit 716 are programmed by a system CPU 602 using target accesses and by the audio synthesizer 708. Accordingly, master bus cycles are initiated both from the system CPU 602 and from the audio synthesizer 708.

In the case of master write signals, the PCI bus master control unit 716, when the access is requested, moves data from the buffer of a requesting machine (not shown) on the PCI bus 620 into the PCI master write data FIFO 720. In one example, the PCI bus master control unit 716 moves data from an audio codec record path FIFO (not shown) into the PCI master write data FIFO 720. The PCI bus master control unit 716 then performs a plurality of master bus cycles.

In the case of master read cycles, the PCI bus master control unit 716 first performs the master bus cycles to move data from the system memory 606 into the PCI master read data FIFO 718. Then the PCI bus master control unit 716 moves the data to the buffer of the requesting machine on the PCI bus 620.

The audio wavetable synthesizer 610 includes many features for improving audio performance by increasing data flow from the PCI bus 620 to the audio DSP 756. The highest performance data flowpath is the master data flowpath through the MAD bus 730 and either the PCI master read data FIFO 718 or the PCI master write data FIFO 720, depending on the data flow direction. The master data flow path is isolated from the 16-bit GEN bus 728 and the 16-bit synthesizer bus 750, instead traversing the TMP bus 732 to prevent the buses internal to the audio wavetable synthesizer 610 from choking other system data flow through the audio wavetable synthesizer 610.

The remainder of the data flow, not including the master data flowpath, traverses the GEN bus 728. Target data accesses typically pass through the GEN bus 728 to destinations including the system memory 606 and various internal registers throughout the audio wavetable synthesizer 610. Low bandwidth master data also flows via the GEN bus 728. The synthesizer bus 750 in the audio synthesizer 708 is a separate extension to the GEN bus 728 and forms a primary communication bus for the synthesizer bus controller 754, the audio DSP 756, the PCI-Audio data controller 760, and the audio SRAM 762. The synthesizer bus 750 is isolated from the GEN bus 728 so that data flows over the synthesizer bus 750 without a heavy amount of bus traffic choking the GEN bus 728. Both the GEN bus 728 and the synthesizer bus 750 use the same communication protocol and an identical addressing scheme.

In the described embodiment, the audio DSP 756 includes an audio digital-to-analog converter (DAC) (not shown) operating at a rate of 44,100 samples per second (44.1 kHz). Accordingly, the output data rate of the audio DSP 756 is 44.1 kHz, although the input data rate can be substantially any rate. One sample period is called a frame. A group of 32 samples is called a frame batch. The audio DSP 756 includes two 32-sample stereo accumulators (not shown) for passing data to the audio DAC. As a first audio DAC is updated with the next frame batch for transfer to the audio DAC, a second audio DAC passes current data to the audio DAC.

Nearly all blocks of the audio wavetable synthesizer 610 operate synchronously at the clock rate of the PCI bus 620, typically 33 MHz. The blocks operating at the clock rate of the PCI bus 620 include the PCI bus interface unit 702, the audio synthesizer 708 and all buses. The audio codec 704 and a telephony codec (not shown), which may be included in other embodiments of an audio wavetable synthesizer, operate at various selected rates that are typically based upon a 16.9344 MHz oscillator.

While the invention has been described with reference to various embodiments, it will be understood that these embodiments are illustrative and that the scope of the invention is not limited to them. Many variations, modifications, additions and improvements of the embodiments described are possible. For example, those skilled in the art will readily implement the steps necessary to provide the structures and methods disclosed herein, and will understand that the process parameters, materials, and dimensions are given by way of example only and can be varied to achieve the desired structure as well as modifications which are within the scope of the invention. Variations and modifications of the embodiments disclosed herein may be made based on the description set forth herein, without departing from the scope and spirit of the invention as set forth in the following claims.

For example, the wavetable system may be implemented on a single integrated circuit chip or formed on multiple chips.

Also, although the wavetable cache is described in terms of a system which is connected to a PCI bus interface, other interfaces such as the Small Computer Systems Interface (SCSI), the 486 bus interface, the ISA interface, the EISA interface, the VESA interface and the like may also be employed.

In various embodiments, the wavetable data burst controller 212 may be located in various blocks such as the CPU 602, the Host/PCI/Cache interface 604, the audio peripheral 610, or other suitable blocks. For example, the wavetable data burst controller 212 may be located within blocks of the audio peripheral 610 such as the bus interface circuit 710, the master state machine 712, the target state machine 714, the audio data controller 760, or other blocks.

What is claimed is:

1. An audio wavetable synthesizer comprising:

an interface bus that transfers data using a burst transmission of a plurality of data samples having a burst size;

a memory coupled to the interface bus and including a voice sample storage patch including a plurality of loop samples beginning at a start address and extending to an end address, the voice sample storage patch further including a plurality of repeated loop samples repeating the voice sample storage patch samples beginning at the start address and extending the burst size, the repeated loop samples being appended to the voice sample storage patch following the end address sample;

a wavetable audio synthesis device coupled to the interface bus to receive the burst-size plurality of data samples from the memory; and a burst data transmission interface that controls the burst transmission from the memory to the wavetable audio synthesis device, the burst data transmission interface controlling the burst transmission to transfer a burst of data extending past the end address to include at least one repeated loop sample, the burst data transmission interface resetting an address of the next burst beyond the start address to account for the at least one repeated loop sample.

2. An audio table synthesizer according to claim 1 wherein:

the voice sample storage patch further includes:

a plurality of ramp samples beginning at an initial address and extending to the start address; and the burst data transmission interface controlling burst transmission to transfer a burst of data extending from an address between the initial address and the start address.

3. An audio table synthesizer according to claim 1 further comprising:

a processor coupled to the interface bus.

4. An audio table synthesizer according to claim 1 wherein the wavetable audio synthesis device and the burst data transmission interface are constructed in a single integrated circuit chip.

5. An audio table synthesizer according to claim 1 wherein the audio table synthesizer is constructed in a single integrated circuit chip.

6. An audio table synthesizer according to claim 1 wherein the interface bus is selected from among:

a PCI bus interface, a Small Computer Systems Interface (SCSI), a 486 bus interface, an ISA interface, an EISA interface, and a VESA interface.

7. An audio wavetable synthesizer for usage with a system including an interface bus and a memory, the interface bus transferring data using a burst transmission of a plurality of data samples having a burst size, the memory coupled to the interface bus and including a voice sample storage patch including a plurality of loop samples beginning at a start address and extending to an end address, the voice sample storage patch further including a plurality of repeated loop samples repeating the voice sample storage patch samples beginning at the start address and extending the burst size, the repeated loop samples being appended to the voice sample storage patch following the end address sample, the audio wavetable synthesizer comprising:

a wavetable audio synthesis device coupled to the interface bus to receive the burst-size plurality of data samples from the memory; and a burst data transmission interface that controls the burst transmission from the memory to the wavetable audio synthesis device, the burst data transmission interface controlling the burst transmission to transfer a burst of data extending past the end address to include at least one repeated loop sample, the burst data transmission interface resetting an address of the next burst beyond the start address to account for the at least one repeated loop sample.

8. An audio table synthesizer according to claim 7 wherein:

the voice sample storage patch further includes:

a plurality of ramp samples beginning at an initial address and extending to the start address; and the burst data transmission interface controlling burst transmission to transfer a burst of data extending from an address between the initial address and the start address.

9. An audio table synthesizer according to claim 7 further comprising:

a processor coupled to the interface bus.

10. An audio table synthesizer according to claim 7 wherein the wavetable audio synthesis device and the burst data transmission interface are constructed in a single integrated circuit chip.

11. An audio table synthesizer according to claim 7 wherein the interface bus is selected from among:

a PCI bus interface, a Small Computer Systems Interface (SCSI), a 486 bus interface, an ISA interface, an EISA interface, and a VESA interface.

12. A method of operating an audio wavetable synthesizer comprising:

configuring a memory to include a voice sample storage patch including a plurality of loop samples beginning at a start address and extending to an end address, the voice sample storage patch further including a plurality of repeated loop samples repeating the voice sample storage patch samples beginning at the start address and extending the burst size, the repeated loop samples being appended to the voice sample storage patch following the end address sample;

transferring data from the memory to a wavetable audio synthesis device in bursts of the burst-size plurality of data samples;

controlling the burst transmission to transfer a burst of data extending past the end address to include at least one repeated loop sample; and resetting an address of the next burst beyond the start address to account for the at least one repeated loop sample.

13. A method according to claim 12 further comprising:

configuring the memory to farther include in the voice sample storage patch a plurality of ramp samples beginning at an initial address and extending to the start address; and controlling burst transmission to transfer a burst of data extending from an address between the initial address and the start address.

14. A memory for usage with an audio wavetable synthesizer comprising:

a voice sample storage patch including:

a plurality of loop samples beginning at a start address and extending to an end address; and a plurality of repeated loop samples repeating the voice sample storage patch samples beginning at the start address and extending the burst size, the repeated loop samples being appended to the voice sample storage patch following the end address sample.

15. A memory according to claim 14 wherein the voice sample storage patch further includes:

a plurality of ramp samples beginning at an initial address and extending to the start address.

16. A computer system comprising:

a processor;

an interface bus coupled to the processor, the processor transferring data using a burst transmission of a plurality of data samples having a burst size;

a memory coupled to the interface bus and including a voice sample storage patch including a plurality of loop samples beginning at a start address and extending to an end address, the voice sample storage patch further including a plurality of repeated loop samples repeating the voice sample storage patch samples beginning at the start address and extending the burst size, the repeated loop samples being appended to the voice sample storage patch following the end address sample;

a wavetable audio synthesis device coupled to the interface bus to receive the burst-size plurality of data samples from the memory; and a burst data transmission interface that controls the burst transmission from the memory to the wavetable audio synthesis device, the burst data transmission interface controlling the burst transmission to transfer a burst of data extending past the end address to include at least one repeated loop sample, the burst data transmission interface resetting an address of the next burst beyond the start address to account for the at least one repeated loop sample.

17. A computer system according to claim 16 wherein:

the voice sample storage patch further includes:

a plurality of ramp samples beginning at an initial address and extending to the start address; and the burst data transmission interface controlling burst transmission to transfer a burst of data extending from an address between the initial address and the start address.

18. A computer system according to claim 16 wherein the wavetable audio synthesis device and the burst data transmission interface are constructed in a single integrated circuit chip.

19. A computer system according to claim 16 wherein the computer system is constructed in a single integrated circuit chip.

20. A computer system according to claim 16 wherein the interface bus is selected from among:

a PCI bus interface, a Small Computer Systems Interface (SCSI), a 486 bus interface, an ISA interface, an EISA interface, and a VESA interface.

* * * * *